US008491156B2

(12) United States Patent
Lee et al.

(10) Patent No.: US 8,491,156 B2
(45) Date of Patent: Jul. 23, 2013

(54) LIGHTING DEVICE HAVING A HOUSING WITH A PLURALTITY OF HOLES FOR EFFECTIVE HEAT DISSIPATION

(75) Inventors: Tsung-Chi Lee, New Taipei (TW); Shih-Chang Hsu, New Taipei (TW)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 88 days.

(21) Appl. No.: 13/279,271

(22) Filed: Oct. 22, 2011

(65) Prior Publication Data

US 2012/0182736 A1 Jul. 19, 2012

(30) Foreign Application Priority Data

Jan. 13, 2011 (CN) ..... 2011 1 0006037

(51) Int. Cl.
*F21V 29/00* (2006.01)
*F21V 21/00* (2006.01)

(52) U.S. Cl.
USPC ..... 362/249.02; 362/373

(58) Field of Classification Search
CPC ... F21V 29/00; F21V 21/00; G06F 1/20; H01L 2023/405
USPC ..... 362/249.2, 373, 294; 313/46, 512
See application file for complete search history.

(56) References Cited

U.S. PATENT DOCUMENTS

2012/0224360 A1* 9/2012 Lee et al. ..... 362/191
2012/0230026 A1* 9/2012 Li et al. ..... 362/235

* cited by examiner

*Primary Examiner* — Tracie Y Green
(74) *Attorney, Agent, or Firm* — Li & Cai Intellectual Property (USA) Office

(57) ABSTRACT

A lighting device includes a light source module and a housing mated to a heat sink and covered by a cover. The housing has a first shell portion encircled by an inner sidewall of the heat sink. Alternatively, the housing may further has a second shell portion arranged between the first shell portion and the inner sidewall of the heat sink. The respective ends of the first and second shell portions are covered by a first plate portion and a connecting portion. A cavity is defined by the first shell portion and the first plate portion for accommodating the light source module. A plurality of first thru-holes, second thru holes, third thru holes, fourth thru-holes, and fifth thru holes are formed on the circuit board, the connecting portion, the cover, the first shell portion, and the first plate portion, respectively.

21 Claims, 8 Drawing Sheets

LIGHTING DEVICE HAVING A HOUSING WITH A PLURALTITY OF HOLES FOR EFFECTIVE HEAT DISSIPATION

BACKGROUND OF THE INVENTION

1. Field of the Invention

The present invention relates to a lighting device; more particularly, to a lighting device having a plurality of heat dissipating holes on a housing thereof for improved heat dissipation.

2. Description of Related Art

Many conventional light emitting diode (LED) designs suffer poor thermal conductivity, particularly on and around the circuit boards. Also, many conventional lighting devices have their LEDs disposed in a cavity, thus the hot air being generated inside the cavity cannot be dissipated easily. In addition, the housing of the conventional lighting devices often blocks the air to flow, thereby reducing the effectiveness of their onboard heat dissipating devices.

To address the above issues, the inventors propose the following solution.

SUMMARY OF THE INVENTION

The present invention provides a lighting device having an improved heat dissipating structure.

The present invention has the following advantages. Namely, the original thru-holes of the circuit board are enlarged to enhance heat dissipation effect. Therefore, the thru-holes of the housing and the enlarged thru-holes of the circuit board may be formed as the gas passage in the cavity, thereby the gas inside the cavity may be flowed for performing the heat exchange.

In order to further appreciate the characteristics and technical contents of the present invention, references are hereunder made to the detailed descriptions and appended drawings in connection with the present invention. However, the appended drawings are merely shown for exemplary purposes, rather than being used to restrict the scope of the present invention.

DETAILED DESCRIPTION OF PREFERRED EMBODIMENTS

Figure 1:
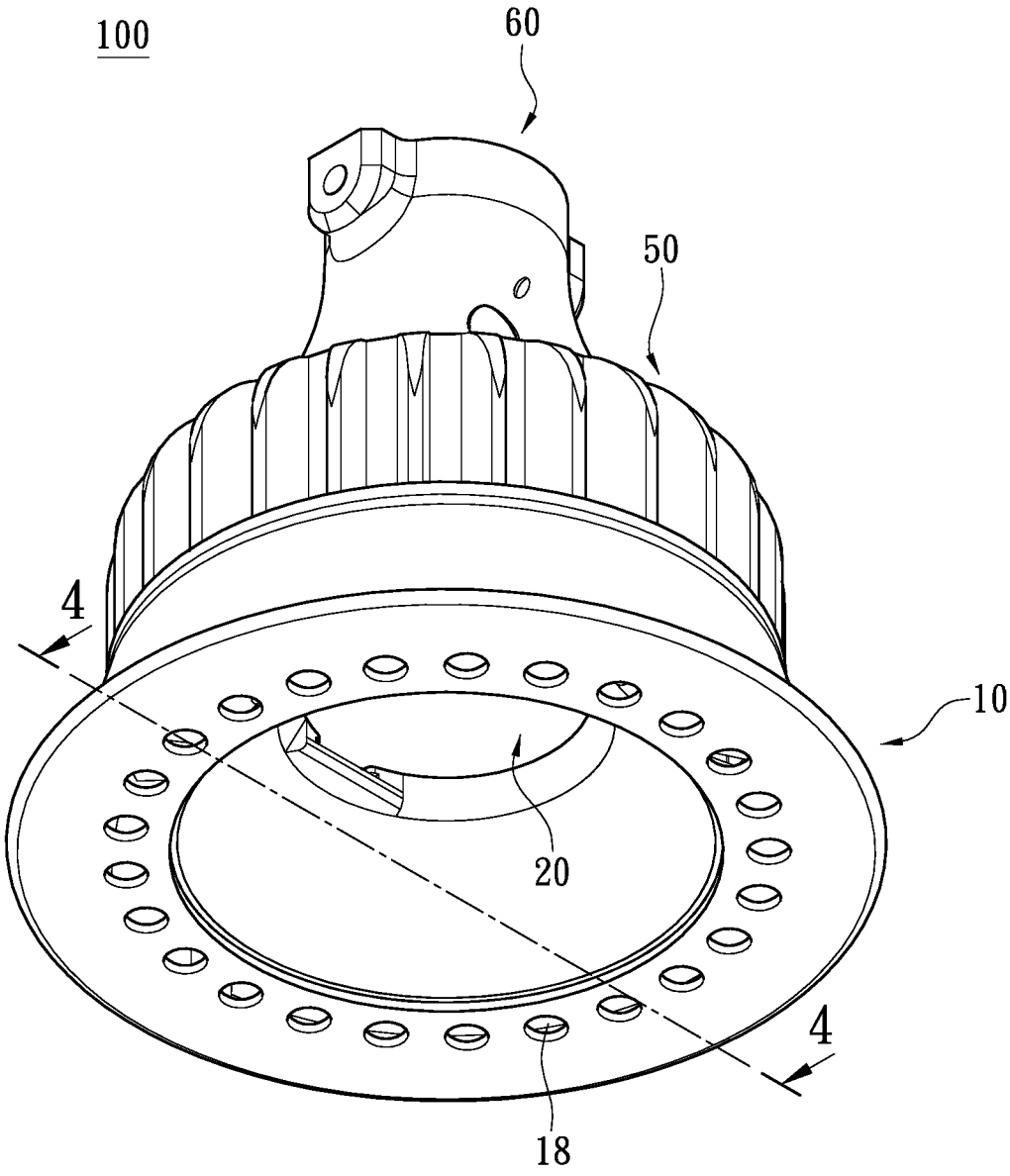
FIG. 1 shows a perspective view of the lighting device of the present invention.
Figure 2:
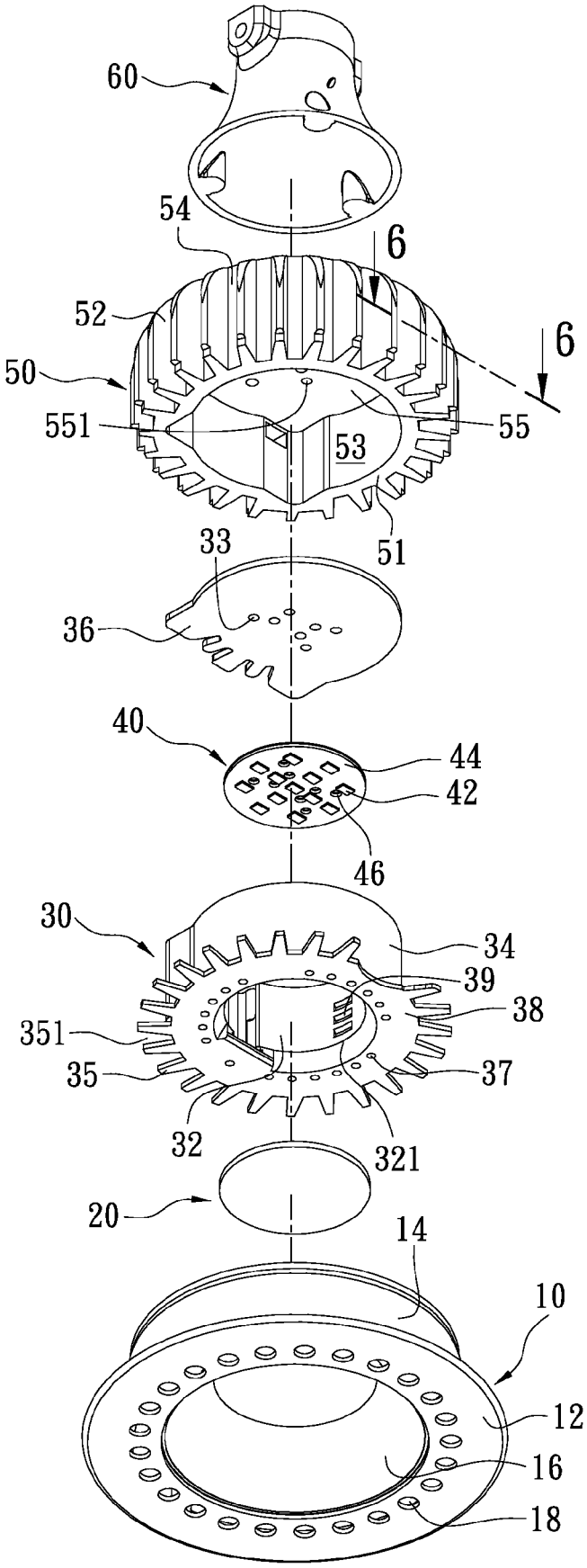
FIG. 2 shows an exploded view of the lighting device of the present invention.
Figure 3:
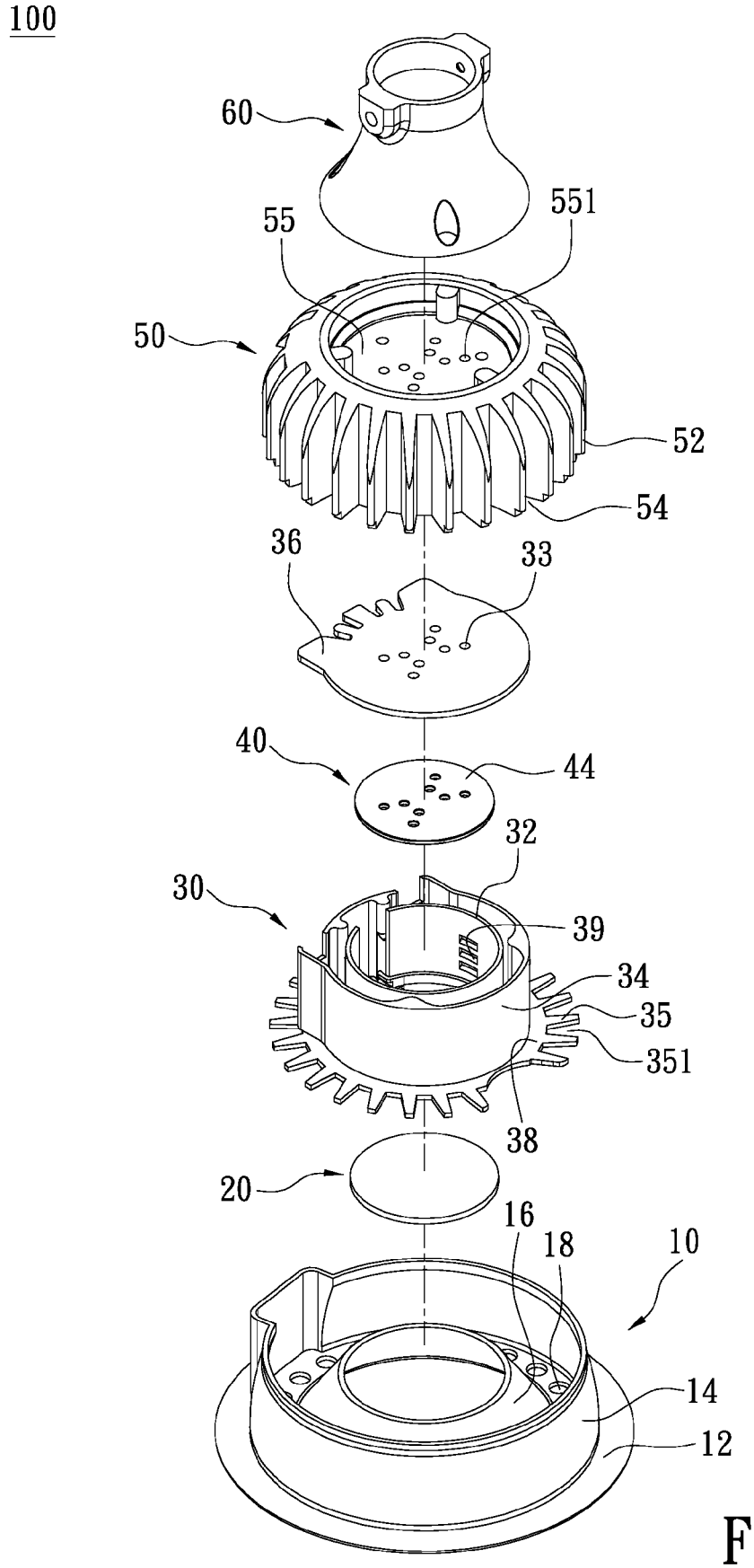
FIG. 3 shows another exploded view of the lighting device of the present invention.
Figure 4:
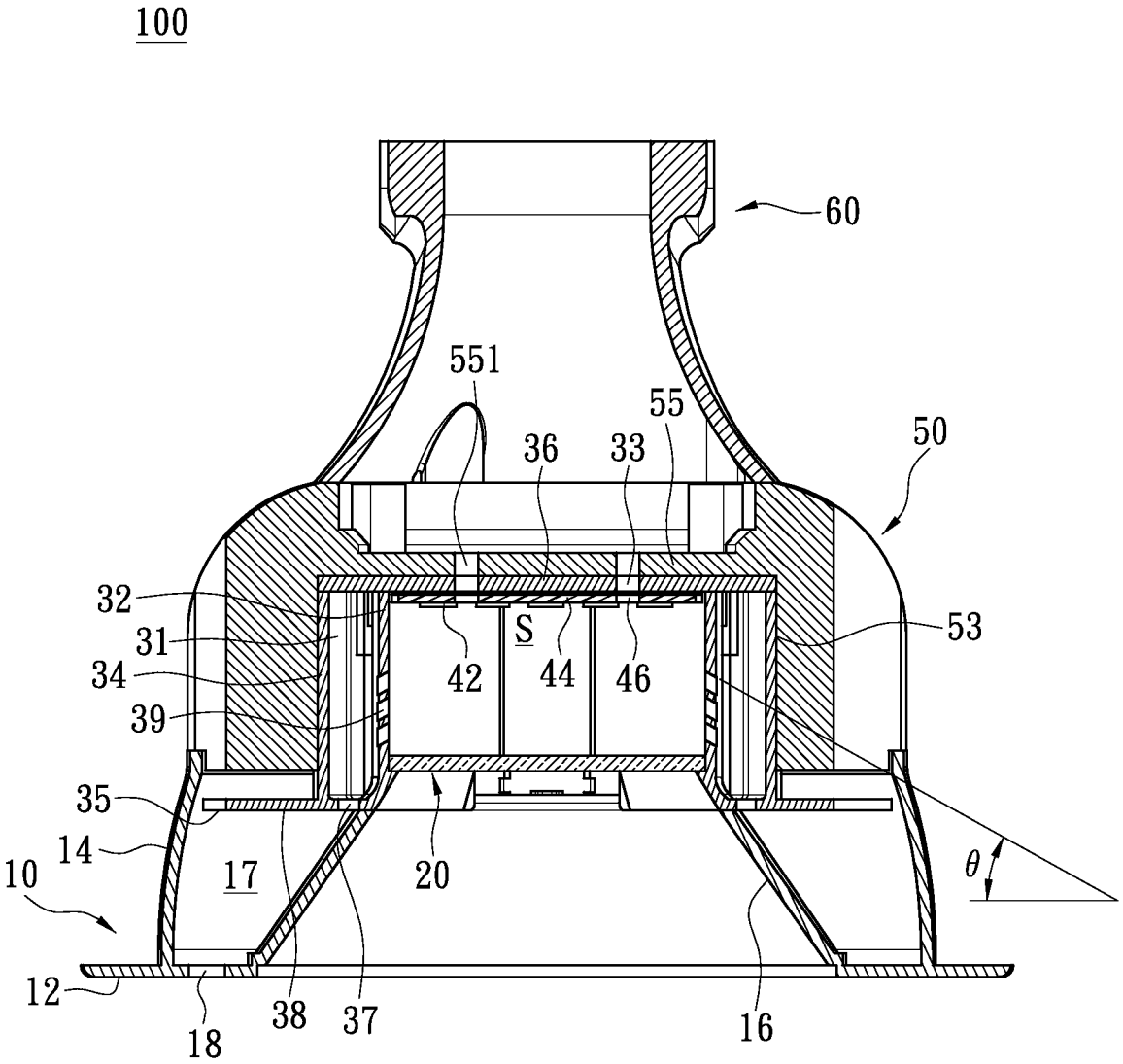
FIG. 4 shows a sectional view of FIG. 1 (cut line 4-4).

Please note that, in the following description, the referenced directions (up, down, left, right, front or rear) are merely for explaining the appended drawings, rather than being used to restrict the scope of the present invention. Please refer to FIGS. 1 to 4. A disclosed lighting device 100 comprises a cover 10, a cover plate 20, a housing 30, a light source module 40, a heat sink 50, and a holder 60.

The housing 30 comprises a first shell portion 32, a second shell portion 34, a first plate portion 36, and a connecting portion 38 and may be made of metallic or other thermal conductive material. The first shell portion 32 and the second shell portion 34 are barrel-shaped. The second shell portion 34 encircles the first shell portion 32 with a specified distance in-between. Therefore, the housing 30 is a double-walled structure. The first plate portion 36 is disposed on one end (being the top end) of the first shell portion 32 and the second shell portion 34, to cover the first shell portion 32 and the second shell portion 34. A cavity S is formed partly by the first shell portion 32 and the first plate portion 36. In some embodiments, the first plate portion 36 may further comprise a ring-like groove for positioning the first shell portion 32 easily.

The connecting portion 38 is ring-shaped, which is disposed on another end (being the bottom end) of the first shell portion 32 and the second shell portion 34. The connecting portion 38 covers the area in between the first shell portion 32 and the second shell portion 34 and forms an opening 321 at the other (bottom) end of the first shell portion 32. Here, a first compartment 31 is defined by the first shell portion 32, the second shell portion 34, the first plate portion 36, and the connecting portion 38. In addition, the connecting portion 38 has a plurality of saw-shaped protrusions 35 formed radially on the outer periphery thereof. Each of the protrusions 35 is separated from one another by a notch 351 formed in-between.

Alternatively, the second shell portion 34 may be absent from the housing 30. For this configuration (not shown), the first shell portion 32 is encircled by the inner sidewall of the heat sink 50. Meanwhile, the first compartment 31 is cooperatively defined by the first shell portion 32, the inner sidewall of the heat sink 50, the first plate portion 36, and the connecting portion 38.

The cover plate 20 is disposed over the opening 321 of the first shell portion 32, and the cover plate 20 may be a lens or a light-transmitting plate.

The light source module 40 has a plurality of light-emitting diodes (LEDs) 42 and a circuit board 44. The LEDs 42 are disposed on the circuit board 44. The light source module 40 is disposed in the cavity S, and the circuit board 44 is disposed on the first plate portion 36. The light emitted by the LEDs 42 is projected outwardly via the cover plate 20.

The heat sink 50 may be made of metallic and thermally conductive material and includes a main body 51 having a plurality of fins 52 spaced radially on the outer periphery thereof. The main body 51 is open-ended at the top and bottom, and an accommodating space 53 is formed internally to accommodate the housing 30. A plurality of channels 54 for heat dissipation are formed between the fins 52. Each of the channels 54 is in alignment with the corresponding notch 351 to promote air flowing. The number and location of the saw-shaped protrusions 35 are corresponding to that of the fins 52 respectively, and the shape of the protrusions 35 is designed corresponding to the cross-sectional shape of the fins 52. The presence of the protrusions 35 increases the efficiency for heat dissipation. The holder 60 is connected onto the fins 52 of the heat sink 50.

The cover 10 covers the housing 30 and includes a second plate portion 12, a first extension portion 14, and a second extension portion 16. The second plate portion 12 is ring-shaped having a flat surface. The first extension portion 14 and the second extension portion 16 are both cylindrically-shaped with a hollow body and connected to a surface (top surface) of the second plate portion 12. The first extension portion 14 is connected centrally to the second plate portion 12 and extends upward to the fins 52 of the heat sink 50. The second extension portion 16 is connected to the inner edge of the second plate portion 12 and extends upward to the connecting portion 38. The first extension portion 14 encircles the second extension portion 16 and is separated by a specified distance, hence the cover 10 is a double-walled structure. The connecting portion 38 is disposed between the first extension portion 14 and the second extension portion 16. Therefore, a second compartment 17 is formed by the second plate portion 12, the first extension portion 14, the second extension portion 16, and the connecting portion 38. The above discussion gives general structural descriptions for the lighting device 100 of the present invention. The discussion given below focuses on the structural description particularly for heat dissipation.

In use, the LEDs 42 generate heat. To achieve heat dissipation, the housing 30 is received in the accommodating space 53 of the heat sink 50, so that the heat may be dissipated by the fins 52 of the heat sink 50. In addition, a plurality of first thru-holes 46 are formed on the circuit board 44. A plurality of second thru-holes 37 are formed on the connecting portion 38. A plurality of third thru-holes 18 are formed on the second plate portion 12. The third thru-holes 18 are disposed between the first extension portion 14 and the second extension portion 16. A plurality of fourth thru-holes 39 are formed on the sidewall of the first shell portion 32. A plurality of fifth thru-holes 33 are formed on the first plate portion 36. Based on these thru-holes, the hot air in the cavity S is better vented to ambient to improve the heat dissipation. The second thru-holes 37 and the fourth thru-holes 39 are in communication with each other so as to allow air flowing through the first compartment 31. The second thru-holes 37 and the third thru-holes 18 are in communication with each other so as to allow air flowing through the second compartment 17. The fifth thru-holes 33 and the fourth thru-holes 39 are in communication with each other so as to allow the air flowing through the cavity S. The fifth thru-holes 33 are aligned to the first thru-holes 46 with the same port size. Notably, the first thru-holes 46 may be formed by enlarging the original thru-holes of the circuit board 44.

Figure 5:
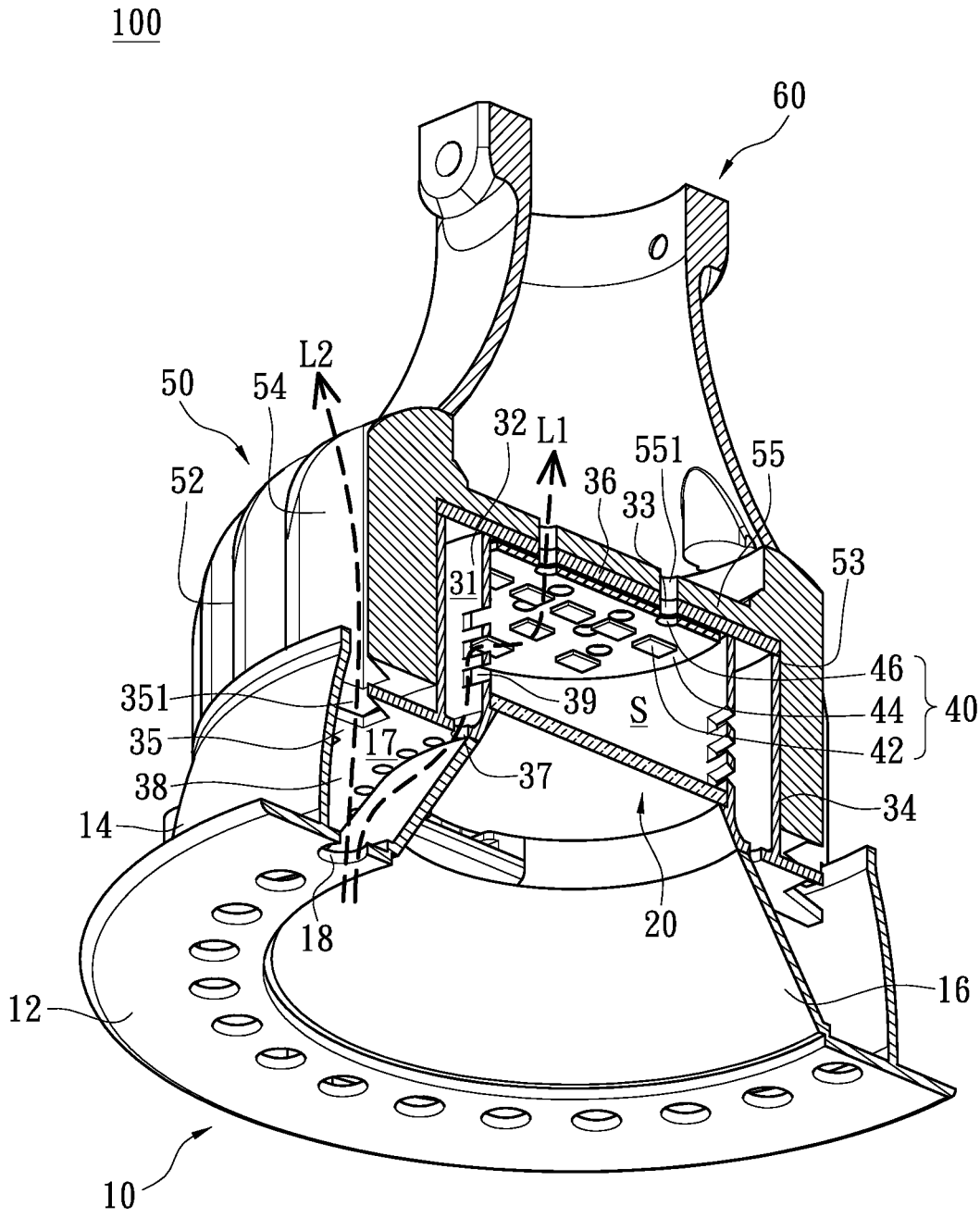
FIG. 5 shows an isometric sectional view of the lighting device of the present invention.

Please refer to FIG. 5; heat is generated by the LEDs 42 inside the cavity S when operating. The ambient air for cooling may enter into the cavity S by flowing along an air flow path L1. The ambient air flows through the third thru-holes 18 of the second plate portion 12, the second thru-holes 37 of the connecting portion 38, the fourth thru-holes 39 of the first shell portion 32, and enter the cavity S sequentially. The hot air flows to the environment via the first thru-holes 46 and the fifth thru-holes 33. Thus, air flowing is created when the hot air flows outside from the cavity S and cooling air enters therein, thereby improving the heat dissipation efficiency of the lighting device 100. In addition, cooling air can also travel through another air flow path L2 by entering the second compartment 17 via the third thru-holes 18. The cooling air then exits from the second compartment 17 through the notches 351 and vents from the lighting device 100 through the channels 54 of the fins 52. Such air flowing also improves the heat dissipation efficiency of the lighting device 100.

Figure 7:
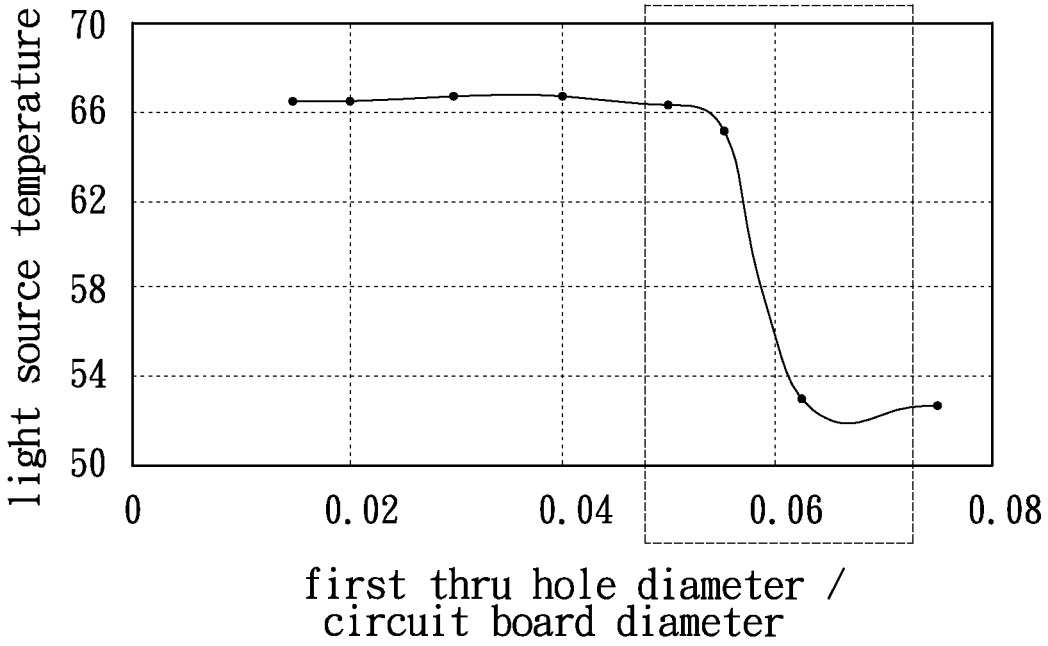
FIG. 7 is a graph showing the ratio of the first thru-hole diameter to the diameter of the circuit board versus the light source temperature.
Figure 9:
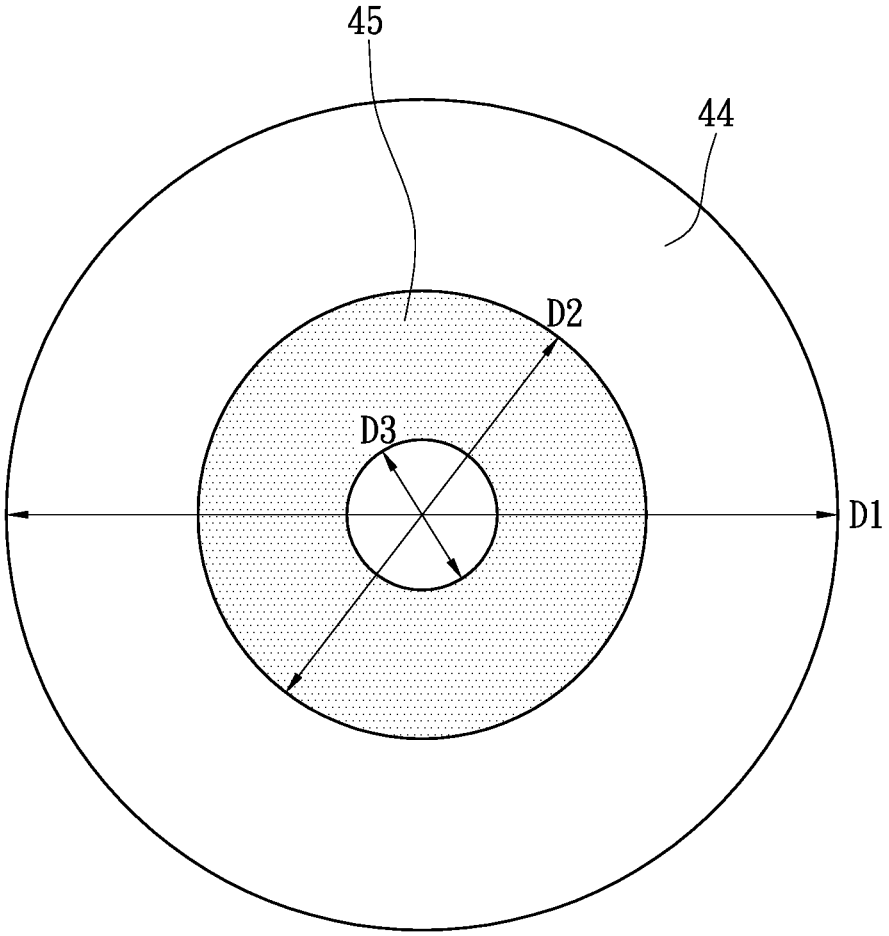
FIG. 9 is a top view of the circuit board of the lighting device of the present invention.

Please refer to FIG. 9. To achieve excellent heat dissipation, the first thru-holes 46 are distributed in a ring-like region 45 on the circuit board 44. The ring-like region 45 is defined by an inner diameter D3 and an outer diameter D2, wherein the overall diameter of the circuit board 44 is denoted by D1. The ratio of the inner diameter of the ring-like region 45 to the overall diameter of the circuit board 44, or D3/D1, is preferably greater than or equal to 0.3. Meanwhile, the ratio of the outer diameter of the ring-like region 45 to the overall diameter of the circuit board 44, or D2/D1, is preferably less than or equal to 0.6. Please refer to FIG. 7, which shows the relationship between the ratio of the diameter of the first thru-hole 46 to the overall diameter of the circuit board 44 and the temperature of the LEDs 42. Specifically, the horizontal axis represents the ratio of the diameter of the first thru-hole 46 to the overall diameter of the circuit board 44, and the vertical axis represents the temperature of the LEDs 42. As indicated in FIG. 7, when the ratio of the diameter of the first thru-hole 46 to the overall diameter of the circuit board 44 is 0.06, the temperature of the LEDs 42 trends down significantly. The data also suggests the ratio of the diameter of the first thru-hole 46 to the overall diameter of the circuit board 44 is preferably greater than or equal to 0.05 and less than or equal to 0.07 to optimize the heat dissipating effect.

Figure 8:
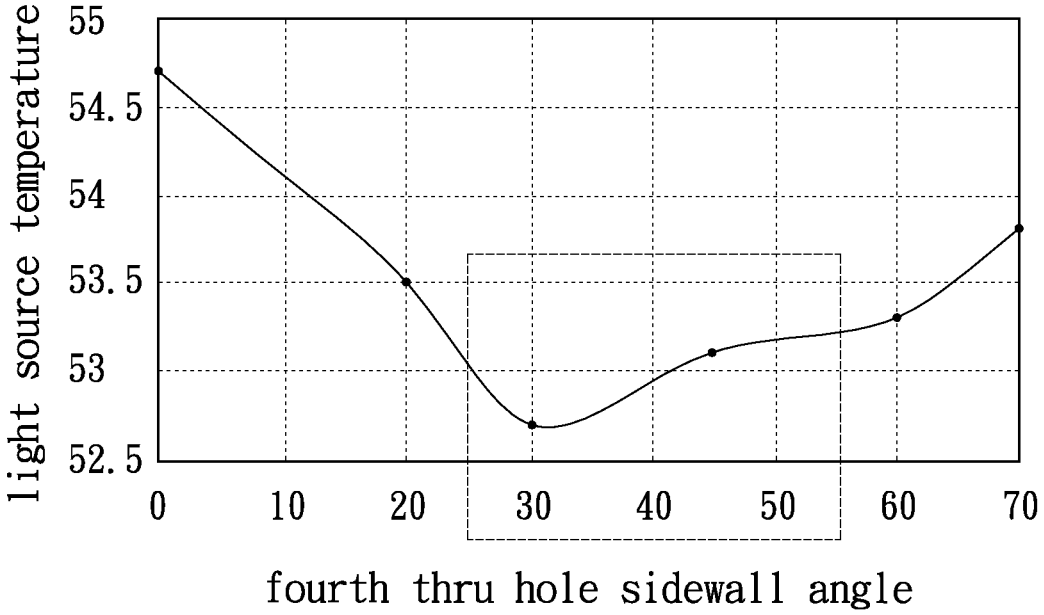
FIG. 8 is a graph showing the angle of the fourth thru-hole versus the light source temperature.

The second thru-holes 37 are radially arranged on the connecting portion 38. Likewise, the third thru-holes 18 are radially arranged on the second plate portion 12. The fourth thru-holes 39 are formed on the sidewall of the first shell portion 32 in columns. In particular, the fourth thru-holes 39 are slanted at an angle θ with respect to the horizontal plane. The angle θ determines the flowing direction of the cooling air toward the circuit board 44 upon entering the first shell portion 32. Please refer to FIG. 8, which shows the relationship between the angle θ and the temperature of the LEDs 42. For the graph, the horizontal axis represents the angle θ, while the vertical axis represents the temperature of the LEDs 42. As shown in FIG. 8, to achieve better heat dissipation, the angle θ is preferably in the range of 25-45 degrees. The distance from the fourth thru-holes 39 to the circuit board 44 is preferably at least one-half height of the first shell portion 32. Such orientation gives best cooling effect as the cooling air enters the first shell portion 32. Furthermore, the cross-sections of the fourth thru-holes 39 of the present invention resemble parallelograms. In other words, the upper and lower sidewalls of the fourth thru-holes 39 are parallel. However, the cross-sectional shape of the fourth thru-holes 39 is not limited thereto, which may also be circular, triangular, etc, as long as the angle θ for each of the fourth thru-holes falls within the above-described range.

Please refer again to FIGS. 2 and 4. The accommodating space 53 of the heat sink 50 may further comprise a base plate portion 55. The first plate portion 36 of the housing 30 is in thermal contact with the base plate portion 55. A plurality of thru-holes 551 are formed on the base plate portion 55 and align to the first thru-holes 46 of the circuit board 44 and the fifth thru-holes 33 of the first plate portion 36. In other words, the thru-holes 551, the first thru-holes 46, and the fifth thru-holes 33 are overlapped with each other.

Figure 6:
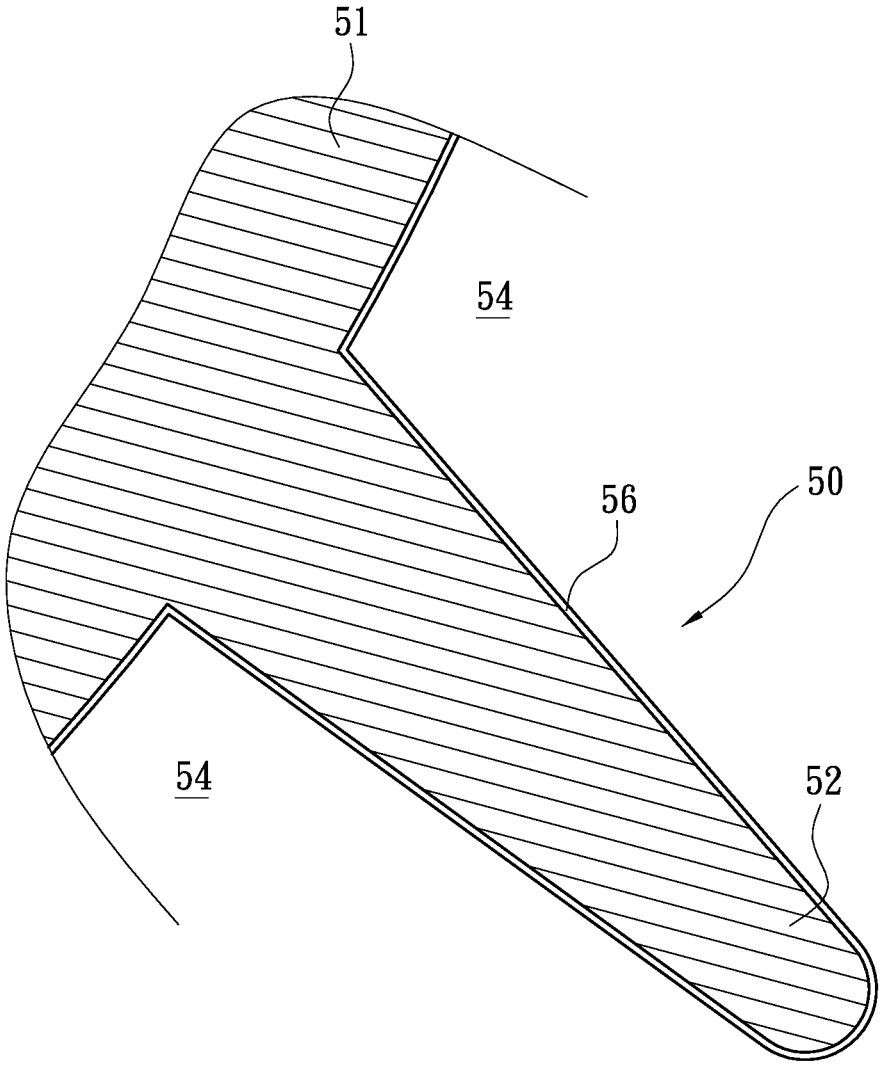
FIG. 6 is a sectional view of FIG. 2 (cut line 6-6).

Furthermore, please refer to FIG. 6. To improve the heat dissipating effect of the fins 52, a ceramic layer 56 is coated on the fins 52 of the heat sink 50 for the lighting device 100 of the present invention. The ceramic layer 56 has a porous structure, which increases the contact surface with the ambient air for heat transfer. However, the ceramic layer 56 must not be too thick, which can adversely affect the heat dissipating properties of the fins 52. Experimental results show the ratio of the thickness of the ceramic layer 56 to the metallic fin 52 is preferably in the range of 0.02 to 0.05, to achieve best heat dissipating effect.

For the present invention, the thru-holes of the circuit board are enlarged to become vent holes (i.e. first thru-holes) to improve heat dissipating effect. In addition, a plurality of fourth and fifth thru-holes are formed on the housing to increase air flow path for improving heat dissipation. The fourth, fifth, and first thru-holes are in communication with each other to form a flowing path to promote air breathing for the cavity of the lighting device. Also, since the ceramic coating over the fins is a porous structure, the heat dissipating area is increased to dissipate heat more effectively and achieve better effect of heat transfer.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A lighting device, comprising:

a housing having a first plate portion and a first shell portion, the first plate portion being disposed at one end of the first shell portion, wherein a cavity is defined by the first shell portion and the first plate portion;

a heat sink having an inner sidewall and being disposed over the housing, the first shell portion being spaced apart and encircled by the inner sidewall, wherein a first compartment is defined by the first shell portion, the first plate portion, and the inner sidewall;

a cover having a second plate portion, a first extension portion, and a second extension portion, the second extension portion being spaced apart and encircled by the first extension portion, the second plate portion being disposed at one end of the first extension portion and the second extension portion, wherein a second compartment is defined by the second plate portion, the first extension portion, the second extension portion, and the heat sink; and a light source module disposed in the cavity and having a circuit board, wherein a plurality of first thru-holes are formed on the circuit board, a plurality of third thru-holes are formed on the second plate portion, a plurality of fourth thru-holes are formed on the first shell portion, a plurality of fifth thru-holes are formed on the first plate portion, wherein the fifth thru-holes and the first thru-holes are overlapped with each other, wherein the third thru-holes and fourth thru-holes are in communication with each other to allow air flowing through the first compartment and the second compartment, the fifth thru-holes and fourth thru-holes are in communication with each other so as to allow air flowing through the cavity.

2. The lighting device of claim 1, wherein the housing further comprises:

a second shell portion being adjacent to the inner sidewall, the first shell portion being spaced apart and encircled by the second shell portion, the first plate portion being disposed at one end of the second shell portion; and a connecting portion being disposed at another end of the first shell portion and second shell portion, the connecting portion being arranged between the first extension portion and the second extension portion of the cover, a plurality of second thru-holes being formed on the connecting portion, wherein each of the fourth thru-holes, the second thru-holes and the third thru-holes are in communication with each other so as to allow air flowing through the first compartment and the second compartment.

3. The lighting device of claim 1, wherein the first thru-holes are distributed in a ring-like region on the circuit board, and wherein a ratio of an inner diameter of the ring-like region to an overall diameter of the circuit board is greater than or equal to 0.3, and a ratio of an outer diameter of the ring-like region to the overall diameter of the circuit board is less than or equal to 0.6.

4. The lighting device of claim 1, wherein a ratio of a diameter of the first thru-hole to an overall diameter of the circuit board is greater than or equal to 0.05 and less than or equal to 0.07.

5. The lighting device of claim 1, wherein the fourth thru-holes are slanted at an angle with respect to a horizontal plane.

6. The lighting device of claim 5, wherein the cross-sectional shape of each of the fourth thru-holes substantially resembles that of a parallelogram.

7. The lighting device of claim 5, wherein the angle is greater than or equal to 25 degrees and less than or equal to 45 degrees.

8. The lighting device of claim 5, wherein a distance from the fourth thru-holes to the circuit board in a perpendicular direction is at least one-half height of the first shell portion.

9. The lighting device of claim 1, wherein the heat sink comprises a plurality of fins arranged radially on the outer periphery thereof.

10. The lighting device of claim 9, wherein each of the fins is coated with a ceramic layer.

11. The lighting device of claim 10, wherein the ceramic layer is a porous structure, and a ratio of a thickness of the ceramic layer to each of the fins is greater than or equal to 0.02 and less than or equal to 0.05.

12. The lighting device of claim 2, wherein the heat sink comprises a plurality of fins arranged radially on the outer periphery thereof, the connecting portion has a plurality of saw-shaped protrusions, a notch being formed between each of the protrusions, a channel for heat dissipation being formed between each of the fins and aligned to the corresponding notch.

13. The lighting device of claim 12, wherein number and location of the saw-shaped protrusions are corresponding to that of the fins respectively, and the cross-sectional shape of each of the protrusions corresponds to the respective fin.

14. The lighting device of claim 12, wherein the protrusions are in alignment with the corresponding fins.

15. The lighting device of claim 9, wherein the heat sink comprises a base plate portion in continuous connection with the inner sidewall cooperatively defining an accommodating space, wherein the base plate portion is in contact with the first plate portion of the housing, and wherein the base plate portion comprises a plurality of thru-holes formed thereon, each of the thru-holes is in alignment with the corresponding first thru-hole and the fifth thru-hole.

16. The lighting device of claim 2, wherein the second plate portion is ring-shaped having a flat surface, the third thru-holes being arranged radially thereon, and wherein the connecting portion is ring-shaped, the second thru-holes being arranged radially thereon.

17. The lighting device of claim 2, wherein the first extension portion extends from the second plate portion to the heat sink, and wherein the second extension portion extends from the second plate portion to the connecting portion.

18. The lighting device of claim 17, wherein the first extension portion is connected centrally to the second plate portion and extends upward to the heat sink, and wherein the second extension portion is connected to the inner edge of the second plate portion and extends upward to the connecting portion.

19. The lighting device of claim 1, wherein the light source module further comprises a plurality of light-emitting diodes, the light-emitting diodes being disposed on the circuit board, and the circuit board being disposed on the first plate portion.

20. The lighting device of claim 2, wherein the second shell portion encircles the first shell portion with a specified distance in-between cooperatively defining a double-walled configuration for the housing.

21. The lighting device of claim 1, wherein the first extension portion encircles the second extension portion with a specified distance in-between cooperatively defining a double-wall configuration for the cover.

* * * * *